US006834866B2

(12) United States Patent
van Egeraat

(10) Patent No.: US 6,834,866 B2
(45) Date of Patent: Dec. 28, 2004

(54) ROLLER SKATE FRAME

(75) Inventor: Hendrikus Adrianus van Egeraat, Örebro (SE)

(73) Assignee: PC-Vane Sportartikel GmbH, Bremerhaven (DE)

( * ) Notice: Subject to any disclaimer, the term of this patent is extended or adjusted under 35 U.S.C. 154(b) by 113 days.

(21) Appl. No.: 10/408,301

(22) Filed: Apr. 7, 2003

(65) Prior Publication Data

US 2004/0195786 A1 Oct. 7, 2004

(51) Int. Cl.[7] ..... A63C 17/06
(52) U.S. Cl. ..... 280/11.221; 280/11.223
(58) Field of Search ..... 280/11.221, 841, 280/11.19, 11.223, 11.224, 11.231, 11.232

(56) References Cited

U.S. PATENT DOCUMENTS 4,711,458 A * 12/1987 Shim ..... 280/11.223
5,251,920 A * 10/1993 McHale ..... 280/11.19
5,765,841 A * 6/1998 Johnson et al. ..... 280/11.224
5,813,678 A * 9/1998 Robins ..... 280/11.204
6,042,124 A * 3/2000 Cheatham et al. ..... 280/11.223
2001/0040351 A1 * 11/2001 Cheatham et al. ..... 280/11.231
2004/0094918 A1 * 5/2004 Egeraat ..... 280/11.223
2004/0145129 A1 * 7/2004 Polanco ..... 280/11.221

* cited by examiner

*Primary Examiner*—Christopher P. Ellis
*Assistant Examiner*—J. Allen Shriver
(74) *Attorney, Agent, or Firm*—Whyte Hirschboeck Dudek SC

(57) ABSTRACT

A roller skate frame includes a wheel-mounting plate for mounting wheels thereon, a shoe-mounting plate projecting transversely from a top end of the wheel-mounting plate and disposed at one side of the wheel-mounting plate that is opposite to the wheels, a plurality of wheel-mounting protrusions projecting from the wheel-mounting plate, and a plurality of reinforcing ribs, each of which projects transversely from a bottom end of the wheel-mounting plate and interconnects two adjacent ones of the protrusions.

8 Claims, 5 Drawing Sheets

ROLLER SKATE FRAME

BACKGROUND OF THE INVENTION

1. Field of the Invention

This invention relates to a roller skate frame, more particularly to a roller skate frame with reinforcing ribs.

2. Description of the Related Art

FIG. 1 illustrates a conventional roller skate frame 11 of a roller skate 1 disclosed in U.S. Pat. No. 6,189,898. The roller skate frame 11 includes a shoe-mounting plate 111 that is adapted to receive a skater's shoe (not shown), and a pair of parallel wheel-mounting plates 112 extending downwardly from the shoe-mounting plate 111. A plurality of wheels 12 (only one is shown) are disposed between and are mounted rotatably on free ends of the wheel-mounting plates 112 through respective axles 114 that extend through the wheel-mounting plates 112. A plurality of screw nuts 115 and washers 116 are used for fastening respective axles 114 to the free ends of the wheel-mounting plates 112. A U-shaped reinforcing plate 113 is connected to the roller skate frame 11 to enhance mechanical strength of the latter.

The aforesaid conventional roller skate frame 11 is disadvantageous in that the free ends of the wheel-mounting plate 112 tend to distort during cornering (as indicated by the imaginary lines shown in FIG. 1), thereby resulting in improper alignment of each wheel 12 relative to the wheel-mounting plates 112, which, in turn, results in undesired friction between the wheels 12 and the wheel-mounting plates 112 and severe wearing of the washers 116, the axles 114 and the wheel-mounting plates 112.

SUMMARY OF THE INVENTION

Therefore, the object of the present invention is to provide a roller skate frame that is capable of overcoming the aforesaid drawbacks of the prior art.

According to the present invention, there is provided a roller skate frame that comprises: a wheel-mounting plate having top and bottom ends, the wheel-mounting plate being formed with a plurality of first through-holes adjacent to the bottom end, each of the first through-holes extending in a transverse direction relative to the wheel-mounting plate; a shoe-mounting plate adapted to receive an article of footwear thereon, projecting in the transverse direction from the top end of the wheel-mounting plate, and disposed at one side of the wheel-mounting plate that is adapted to be opposite to the wheel; a plurality of spaced apart wheel-mounting protrusions, each of which projects from a periphery of a respective one of the first through-holes in the transverse direction, each of which is disposed at the side of the wheel-mounting plate, and each of which defines a second through-hole that extends from a respective one of the first through-holes in the transverse direction; and a plurality of first reinforcing ribs, each of which projects from the bottom end of the wheel-mounting plate in the transverse direction and extends between and interconnects two adjacent ones of the protrusions.

BRIEF DESCRIPTION OF THE DRAWINGS

In drawings which illustrate an embodiment of the invention.

DETAILED DESCRIPTION OF THE PREFERRED EMBODIMENT

Figure 1:
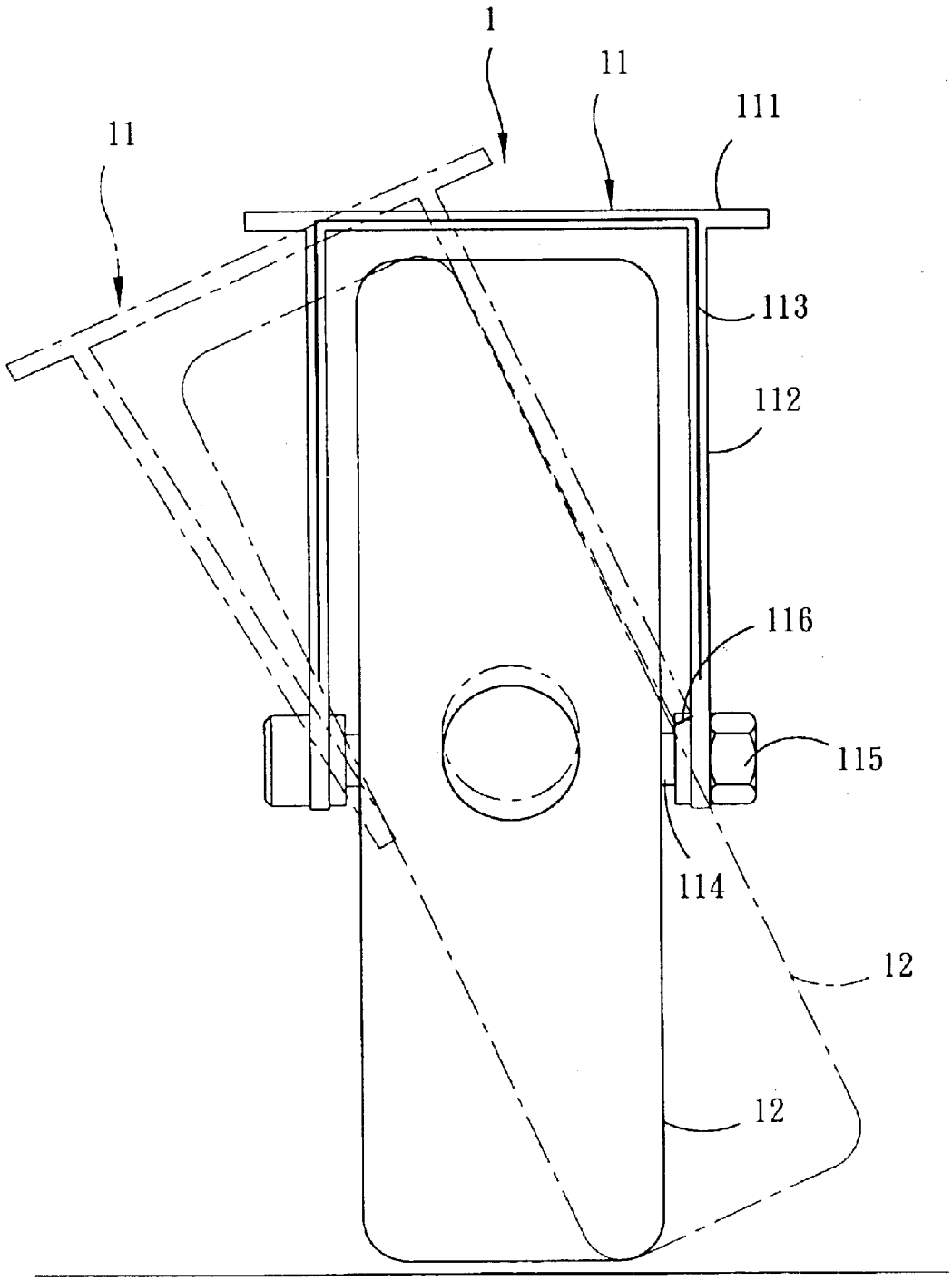
FIG. 1 is a schematic view illustrating how a conventional roller skate frame distorts to contact a wheel during cornering.
Figure 2:
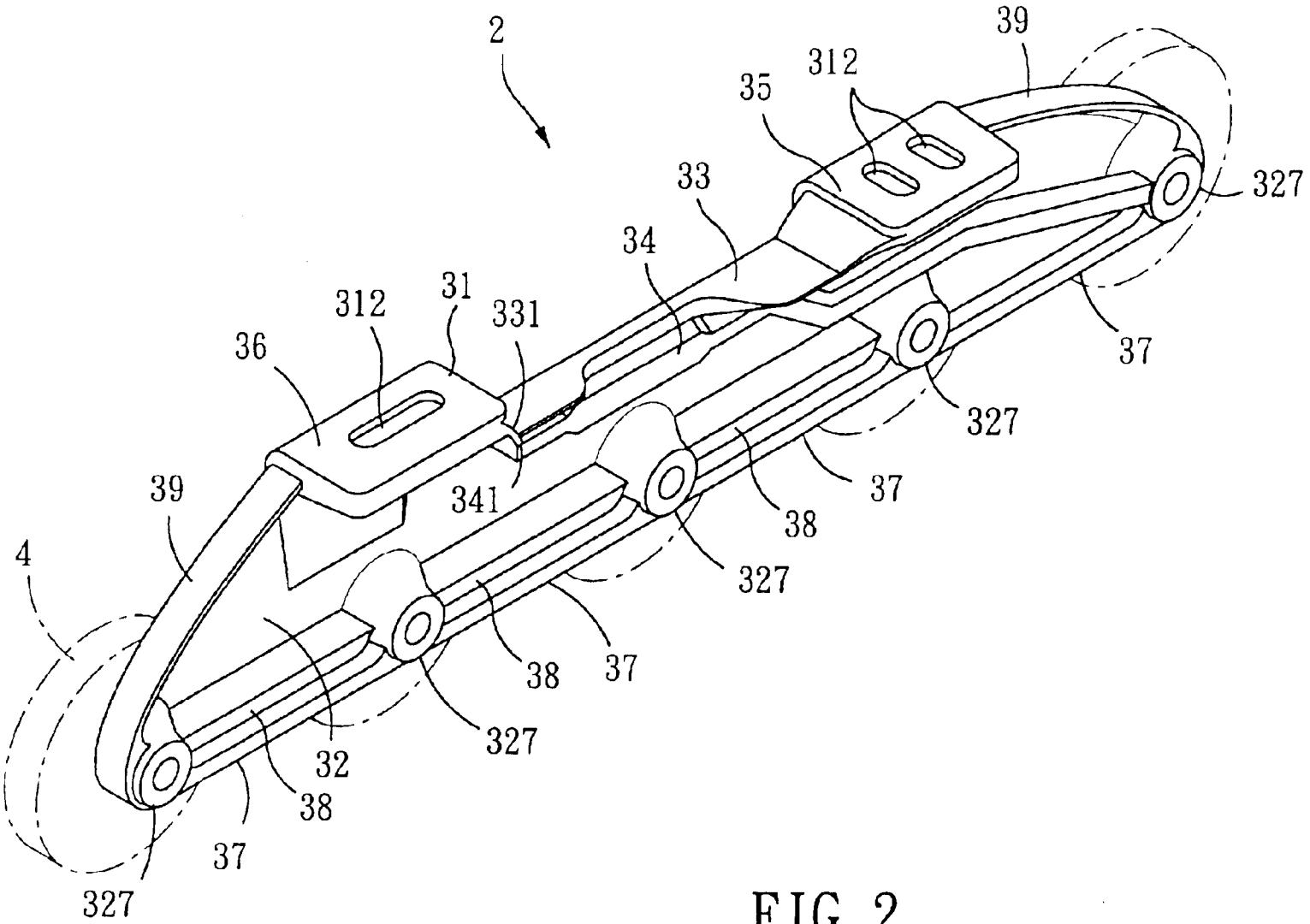
FIG. 2 is a perspective view of a roller skate frame embodying this invention.
Figure 3:
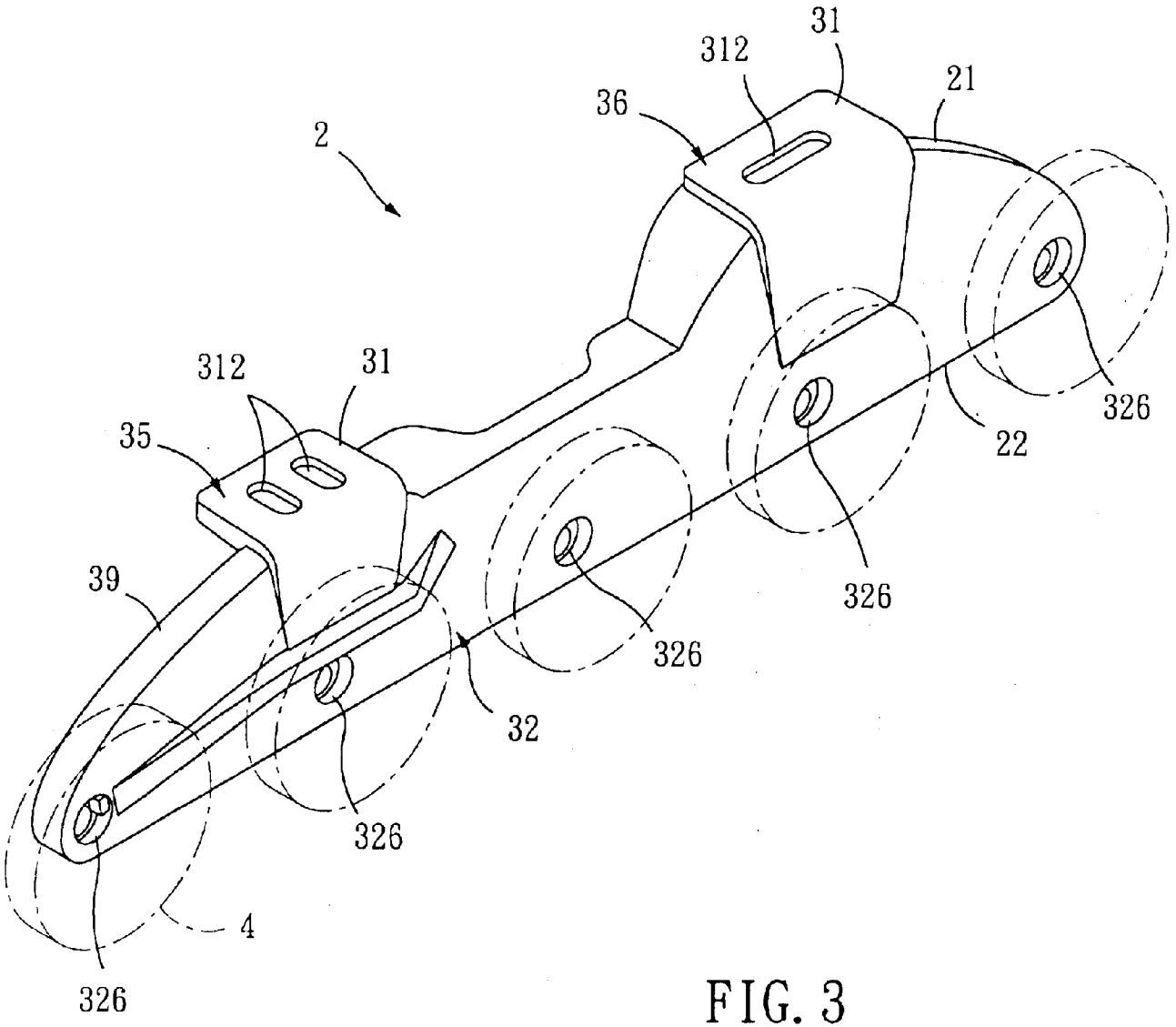
FIG. 3 is another perspective view of the roller skate frame of FIG. 2.
Figure 4:
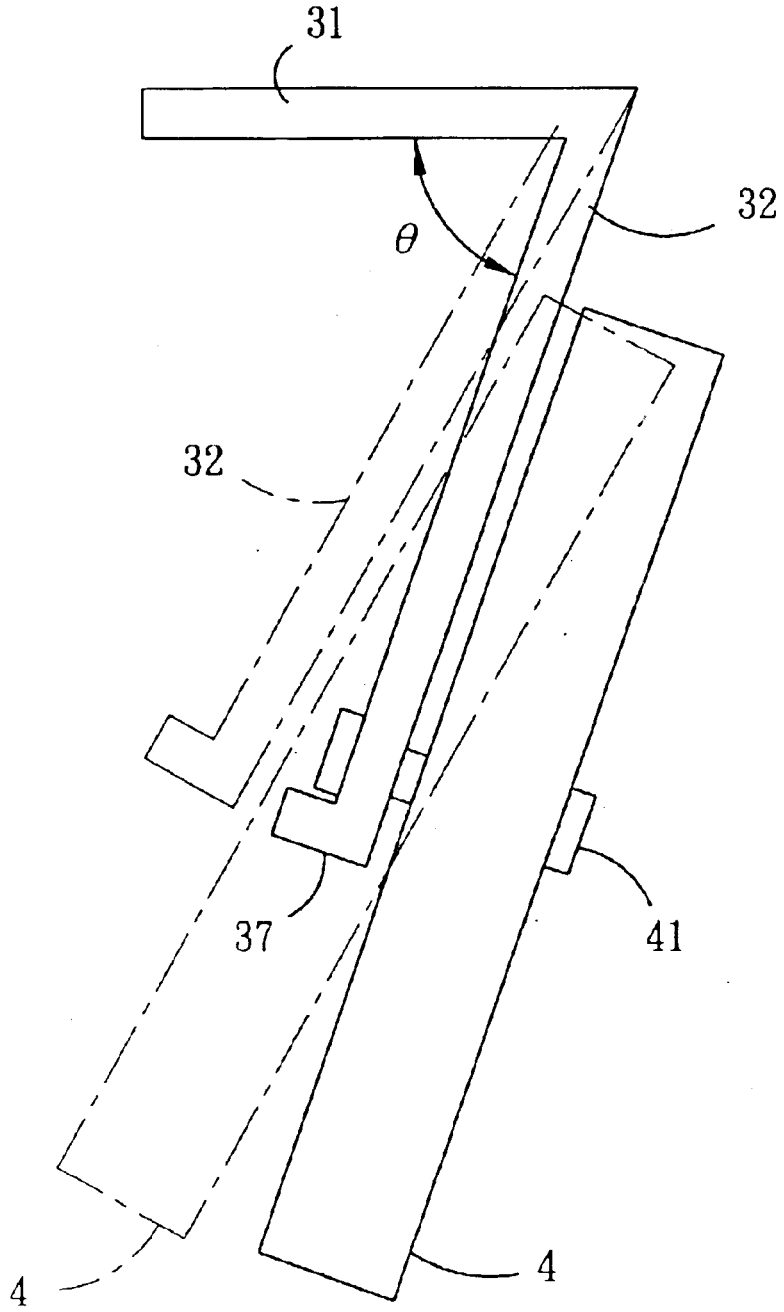
FIG. 4 is a schematic view to illustrate how a wheel is constantly aligned in a position relative to the roller skate frame of FIG. 2.
Figure 5:
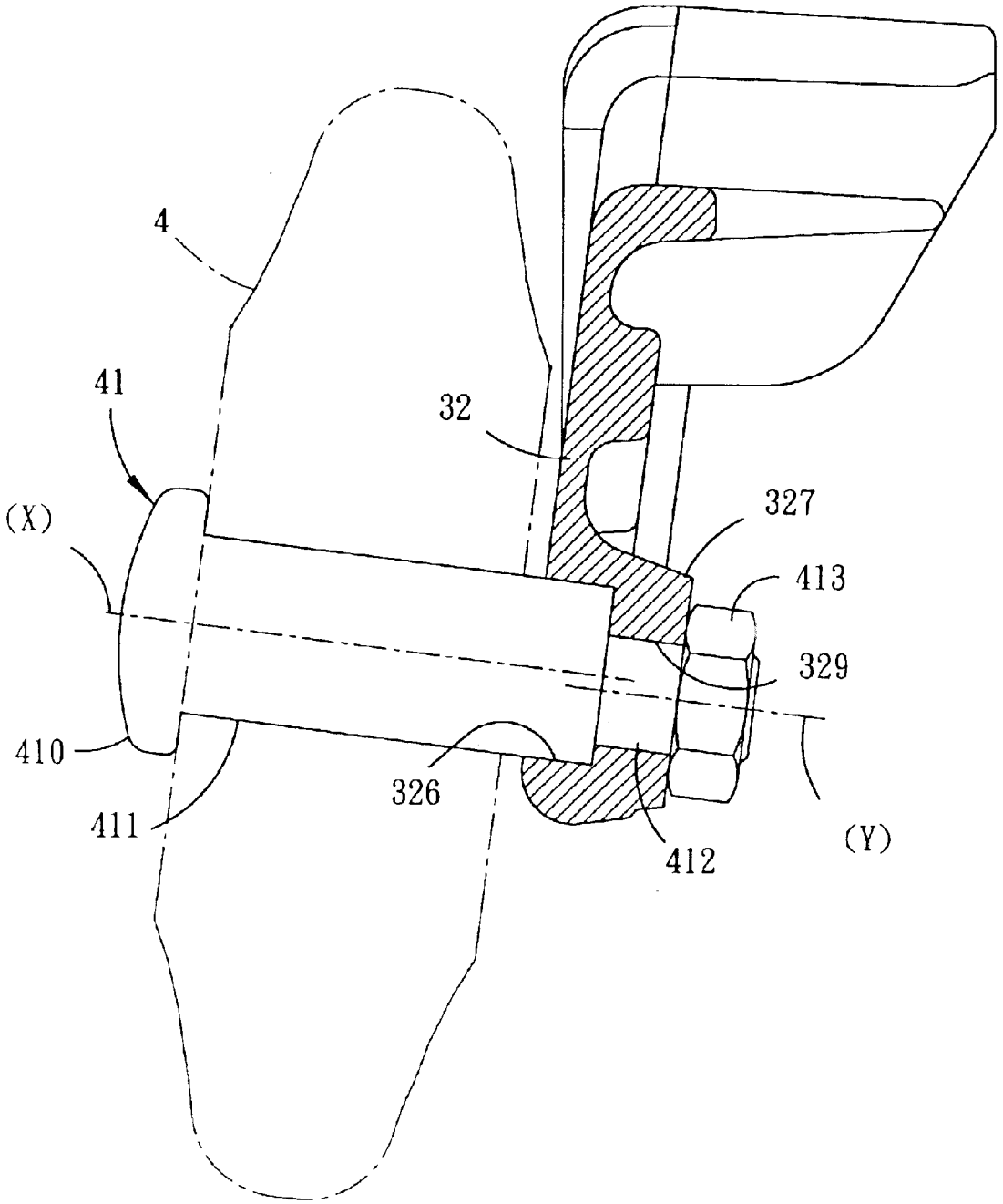
FIG. 5 is a schematic view to illustrate the structure of an axle which connects the wheel to the roller skate frame of FIG. 2.

FIGS. 2 to 5 illustrate a preferred embodiment of a roller skate frame 2 of this invention for a roller skate. A plurality of wheels 4 are adapted to be mounted on the roller skated frame 2 through respective axles 41 (only one axle 41 and one wheel 4 are shown in FIG. 5). Each of the axles 41 has a head 410, a shank 411 that extends and that is reduced from the head 410, and a threaded tail 412 that eccentrically extends and is reduced from the shank 411. Each of the axles 41 is secured to the roller skated frame 2 through threaded engagement between the threaded tail 412 and a screw nut 413. Each of the wheels 4 is mounted rotatably on the shank 411 of a respective one of the axles 4.

The roller skate frame 2 includes: a wheel-mounting plate 32 having top and bottom ends 21, 22 (see FIG. 3), the wheel-mounting plate 32 being formed with a plurality of first through-holes 326 adjacent to the bottom end 22, each of the first through-holes 326 extending in a transverse direction relative to the wheel-mounting plate 32, defining a first axis (X) in the transverse direction, and being adapted to receive the shank 411 of the respective axle 41; a shoe-mounting plate 31 adapted to receive an article of footwear (not shown) thereon, projecting in the transverse direction from the top end 21 of the wheel-mounting plate 32, and disposed at one side of the wheel-mounting plate 32 that is adapted to be opposite to the wheel 4; a plurality of spaced apart wheel-mounting protrusions 327, each of which projects from a periphery of a respective one of the first through-holes 326 in the transverse direction, each of which is disposed at said side of the wheel-mounting plate 32, and each of which defining a second through-hole 329 that eccentrically extends and is reduced from a respective one of the first through-holes 326 in the transverse direction for extension of the threaded tail 412 of the respective axle 41 therethrough, the second through-hole 329 defining a second axis (Y) in the transverse direction, the second axis (Y) being offset from and being parallel to the first axis (X); and a plurality of first reinforcing ribs 37, each of which projects from the bottom end 22 of the wheel-mounting plate 32 in the transverse direction and each of which extends between and interconnects two adjacent ones of the protrusions 327 so as to enhance mechanical strength of the bottom portion of the wheel-mounting plate 32 which is subjected to high stress due to an external force applied to the wheel 4 during skating and so as to prevent distortion of the bottom portion of the wheel-mounting plate 32 as commonly encountered in the aforesaid conventional roller skate frame of the prior art.

Preferably, the wheel-mounting plate 32 and the shoe-mounting plate 31 cooperatively form an acute angle ($\theta$), as best shown in FIG. 4. The wheel-mounting plate 32 is preferably elastically movable relative to the shoe-mounting plate 31 in such a manner that the acute angle ($\theta$) varies in an extent corresponding to the external force applied to the wheel 4 so as to maintain constant alignment of the wheel 4 relative to the wheel-mounting plate 32 during cornering.

A plurality of second reinforcing ribs 38 are formed on the wheel-mounting plate 32. Each of the second reinforcing ribs 38 extends between and interconnects two adjacent ones of the protrusions 327, and is spaced apart from and is parallel to a respective one of the first reinforcing ribs 37 so as to further enhance mechanical strength of the bottom portion of the wheel-mounting plate 32.

The shoe-mounting plate 31 includes a front plate 35 and a rear plate 36 that is spaced apart from and that is disposed rearwardly of the front plate 35. The roller skate frame 2 further includes a generally U-shaped bridging plate 33 that projects from the top end 21 of the wheel-mounting plate 32 in the transverse direction and that extends between and that interconnects the front and rear plates 35, 36.

The bridging plate 33 has a rear end 331 connected to the rear plate 36 of the shoe-mounting plate 31. A third reinforcing rib 34 extends between and interconnects a front most one of the protrusions 327 and the rear end 331 of the bridging plate 33 so as to enhance mechanical strength of the top portion of the wheel-mounting plate 32 which is subjected to high stress due to the load borne by the shoe-mounting plate 31. A pair of curved fourth reinforcing ribs 39 project respectively from front and rear ends of the wheel-mounting plate 32 in the transverse direction. One of the fourth reinforcing ribs 39 extends between and interconnects the front plate 35 and the front most one of the protrusions 327. The other of the fourth reinforcing ribs 39 extends between and interconnects the rear plate 36 and a rearmost one of the protrusions 327.

The front and rear plates 35, 36 are formed with fastener holes 312 for extension of fasteners (not shown) therethrough so as to fasten the skater's shoe to the front and rear plates 35, 36.

The roller skate frame 2 of this invention is preferably an integrally formed single part, and can be made from a carbon fiber reinforced resin material or a metal. The roller skate frame 2 of this invention can be formed by molding a carbon fiber reinforced resin material in a mold (not shown) to form a molded body or by forging a metal body using a die (not shown) to form a forged body in such a manner that the molded body or the forged body has a structure corresponding to that of the roller skate frame 2. The molded body or the forged body is then subjected to machining and trimming.

With the invention thus explained, it is apparent that various modifications and variations can be made without departing from the spirit of the present invention. It is therefore intended that the invention be limited only as recited in the appended claims.

I claim:

1. A roller skate frame comprising:

a wheel-mounting plate having top and bottom ends, said wheel-mounting plate being formed with a plurality of first through-holes adjacent to said bottom end, each of said first through-holes extending in a transverse direction relative to said wheel-mounting plate;

a shoe-mounting plate adapted to receive an article of footwear thereon, projecting in said transverse direction from said top end of said wheel-mounting plate, and disposed at one side of said wheel-mounting plate that is adapted to be opposite to a wheel;

a plurality of spaced apart wheel-mounting protrusions, each of which projects from a periphery of a respective one of said first through-holes in said transverse direction, each of which is disposed at said side of said wheel-mounting plate, and each of which defines a second through-hole that extends from a respective one of said first through-holes in said transverse direction; and a plurality of first reinforcing ribs, each of which projects from said bottom end of said wheel-mounting plate in said transverse direction and extends between and interconnects two adjacent ones of said protrusions.

2. The roller skate frame of claim 1, wherein each of said first through-holes defines a first axis, said second through-hole in each of said wheel-mounting protrusions defining a second axis that is parallel to and that is offset from said first axis, said second through-hole in each of said wheel-mounting protrusions eccentrically extending and being reduced from the respective one of said first through-holes in said transverse direction.

3. The roller skate frame of claim 1, wherein said wheel-mounting plate and said shoe-mounting plate form an acute angle, and said wheel-mounting plate is elastically movable relative to said shoe-mounting plate in such a manner that said acute angle varies in an extent corresponding to an external force applied to the wheel by the ground so as to maintain constant alignment of the wheel relative to said wheel-mounting plate.

4. The roller skate frame of claim 3, further comprising a plurality of second reinforcing ribs, each of which extends between and interconnects two adjacent ones of said protrusions and is spaced apart from and parallel to a respective one of said first reinforcing ribs.

5. The roller skate frame of claim 4, wherein said shoe-mounting plate includes a front plate and a rear plate that is spaced apart from and that is disposed rearwardly of said front plate, said roller skate frame further comprising a generally U-shaped bridging plate that projects from said top end of said wheel-mounting plate in said transverse direction and that extends between and that interconnects said front and rear plates.

6. The roller skate frame of claim 5, wherein said bridging plate has a rear end connected to said rear plate of said shoe-mounting plate, said roller skate frame further comprising a third reinforcing rib that extends between and that interconnects a front most one of said protrusions and said rear end of said bridging plate.

7. The roller skate frame of claim 1, wherein said shoe-mounting plate, said wheel-mounting plate, said protrusions, and said first reinforcing ribs are integrally formed by molding a carbon fiber reinforced resin material to form a molded body that has a structure corresponding to that of said roller skate frame, followed by machining and trimming said molded body.

8. The roller skate frame of claim 1, wherein said shoe-mounting plate, said wheel-mounting plate, said protrusions, and said first reinforcing ribs are integrally formed by forging a metal body to form a forged body that has a structure corresponding to that of said roller skate frame, followed by machining and trimming said forged body.

* * * * *